US009427073B2

(12) United States Patent
Scott

(10) Patent No.: US 9,427,073 B2
(45) Date of Patent: Aug. 30, 2016

(54) INTERCHANGEABLE MODULAR TOOTHBRUSH

(71) Applicant: Michael Scott, Arlington, TX (US)

(72) Inventor: Michael Scott, Arlington, TX (US)

( * ) Notice: Subject to any disclaimer, the term of this patent is extended or adjusted under 35 U.S.C. 154(b) by 232 days.

(21) Appl. No.: 14/293,359

(22) Filed: Jun. 2, 2014

(65) Prior Publication Data

US 2015/0173501 A1 Jun. 25, 2015

Related U.S. Application Data

(60) Provisional application No. 61/964,120, filed on Dec. 24, 2013.

(51) Int. Cl.

| | |
|---|---|
| ***A46B 5/02*** | (2006.01) |
| ***A46B 15/00*** | (2006.01) |
| ***A46B 7/04*** | (2006.01) |
| ***A46B 5/00*** | (2006.01) |
| *A46B 9/04* | (2006.01) |

(52) U.S. Cl.

CPC ..... *A46B 5/0095* (2013.01); *A46B 5/02* (2013.01); *A46B 15/0085* (2013.01); *A46B 15/0097* (2013.01); *A46B 5/023* (2013.01); *A46B 7/04* (2013.01); *A46B 9/04* (2013.01); *A46B 15/0087* (2013.01); *A46B 2200/1066* (2013.01)

(58) Field of Classification Search

CPC ..... A46B 5/00; A46B 5/0095; A46B 5/02; A46B 5/021; A46B 5/023; A46B 5/025; A46B 5/026; A46B 7/04; A46B 7/042; A46B 7/044; A46B 7/046; A46B 7/048; A46B 15/00; A46B 15/0085; A46B 15/0087; A46B 15/0089; A46B 15/0095; A46B 15/0097

USPC ..... 15/143.1, 145, 176.1–176.3, 176.6; 16/111.1; 132/311; 40/314

See application file for complete search history.

(56) References Cited

U.S. PATENT DOCUMENTS

| | | | | |
|---|---|---|---|---|
| 1,378,530 A * | 5/1921 | Evslin | A46B 7/04 15/167.1 |
| 1,497,495 A * | 6/1924 | Fincke | A46B 7/04 15/176.6 |
| 4,033,007 A * | 7/1977 | Hadary | A46B 7/02 132/309 |
| 4,106,152 A * | 8/1978 | Hadary | A46B 7/02 132/308 |
| 5,875,510 A | 3/1999 | Lamond et al. | |
| 5,875,796 A * | 3/1999 | Silver-Isenstadt | A46B 15/0061 132/311 |
| 6,015,328 A | 1/2000 | Glaser | |

(Continued)

FOREIGN PATENT DOCUMENTS

| | | | |
|---|---|---|---|
| FR | 2862191 | * | 5/2005 |
| GB | 350162 | * | 6/1931 |

OTHER PUBLICATIONS

Partial machine translation of FR 2,862,191, May 20, 2005, 1 page.*

*Primary Examiner* — Mark Spisich

(74) *Attorney, Agent, or Firm* — Harpman & Harpman

(57) ABSTRACT

A modular component toothbrush includes a base portion, interchangeable hollow handle portion and a bristle brush portion that is selectively engageable with both handle portion and base portion for assembly. The modular component toothbrush may be personalization by interchangeability of the modular components of different colors and indicia provide for a variety of toothbrush configurations dependent on user's selection defining a custom build a brush toothbrush configuration.

1 Claim, 5 Drawing Sheets

(56) References Cited

U.S. PATENT DOCUMENTS 6,049,936 A * 4/2000 Holley ..... A46B 5/02 15/143.1
6,230,357 B1 * 5/2001 Davis ..... A46B 7/04 15/145
6,334,451 B1 * 1/2002 Yang ..... A46B 11/0027 132/311
6,367,113 B1 * 4/2002 Usui ..... A46B 5/02 15/143.1
6,968,590 B2 11/2005 Ponzini
8,079,109 B2 * 12/2011 Misner ..... A46B 15/0002 15/105
2003/0046780 A1 * 3/2003 Davis ..... A46B 5/0095 15/167.1
2003/0183242 A1 * 10/2003 Kemp ..... A46B 5/00 132/311
2004/0020508 A1 * 2/2004 Earl ..... A46B 5/0033 132/311
2013/0248388 A1 9/2013 Jimenez et al.

* cited by examiner

INTERCHANGEABLE MODULAR TOOTHBRUSH

This applications claims the benefit of U.S. Provisional Application No. 61/964,120, filed on Dec. 24, 2013.

BACKGROUND OF THE INVENTION

1. Technical Field

This invention relates to the construction of a toothbrush having replaceable and/or interchangeable elements.

2. Description of Prior Art

Prior art devices of this type have been directed to a number of different toothbrush configurations having replaceable portions typically centered around the brush head, see for example U.S. Pat. Nos. 5,875,510, 6,015,328, 6,968,590 and U.S. Patent Publication 2013/0248388.

In U.S. Pat. No. 5,875,510 a replaceable head toothbrush is disclosed having a handle with a cavity for receiving interchangeable brush heads by insertion for retainment and removable by a locking pin system.

U.S. Pat. No. 6,015,328 claims a toothbrush toy having interchangeable bendable and poseable character representation within its handle of a fictional toy figure. A brush receiving and retainment insert engages a brush stem and head removable therefrom.

U.S. Pat. No. 6,968,590 is directed towards a disposable toothbrush with positive blocking having a handle portion and a bristled portion with a flexible coupling with an elastomeric mass to impart an elastic reaction during use between the brush head and handle.

Patent Publication 2013/0248388 shows a toothbrush kit having a decorative component for applying to the brush handle with inclusion of a writing instrument to effect application and embellishment of the decorations on the brush handle surface.

SUMMARY OF THE INVENTION

A build a brush configuration for a toothbrush having multiple interchangeable portions to assemble a unique and personalized toothbrush configuration. A brush head and interlocking stem assembly registerably engages within a generally cylindrical handle portion with a corresponding insertable base end portion which is engaged by both the brush head and handle portions defining a stable interlocking brush assembly of a true customizable and interchangeable nature.

DETAILED DESCRIPTION OF THE INVENTION

Figure 1:
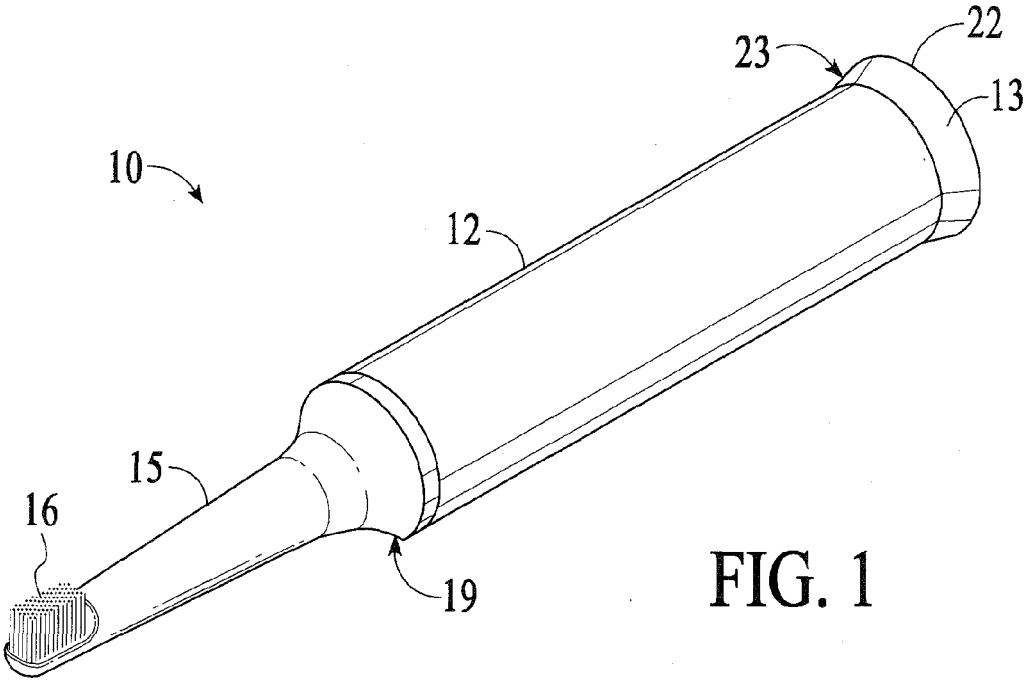
FIG. 1 is a perspective view of the assembled toothbrush of the invention.
Figure 2:
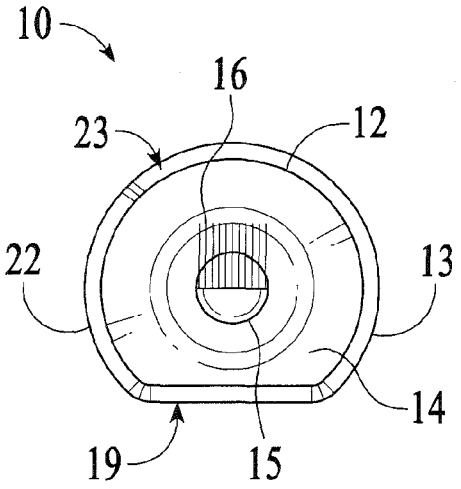
FIG. 2 is an enlarged end view on lines 2-2 of FIG. 1.
Figure 3:
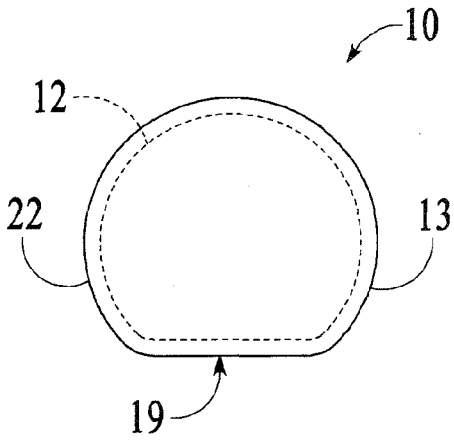
FIG. 3 is an enlarged end view on lines 3-3 of FIG. 1.
Figure 4:
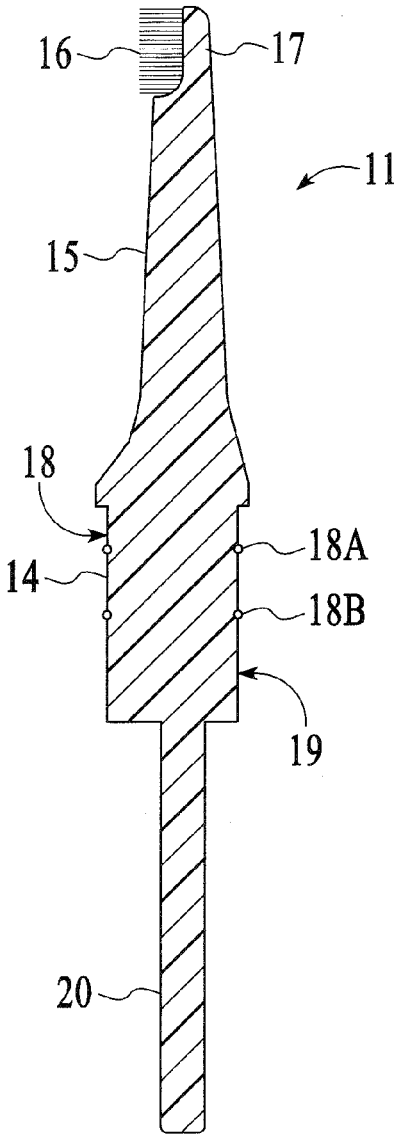
FIG. 4 is an enlarged cross sectional view of the bristle brush head and support portion.
Figure 5:
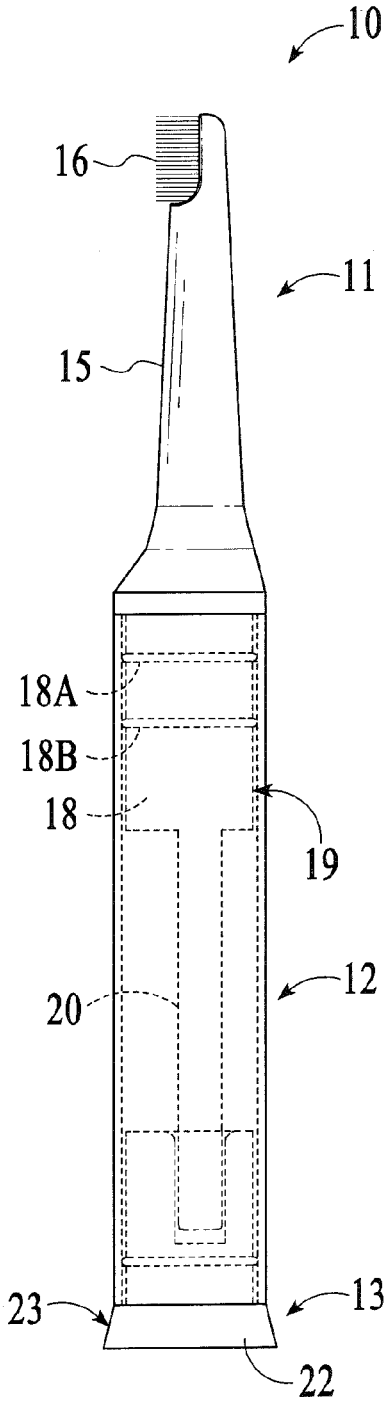
FIG. 5 is a side elevational view of the assembled toothbrush of the invention.
Figure 6:
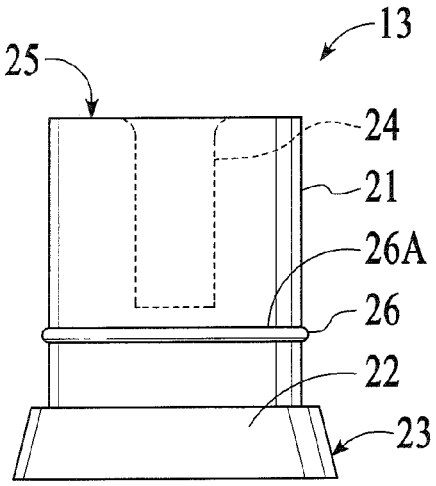
FIG. 6 is an enlarged front elevational view of the handle insert base portion.
Figure 7:
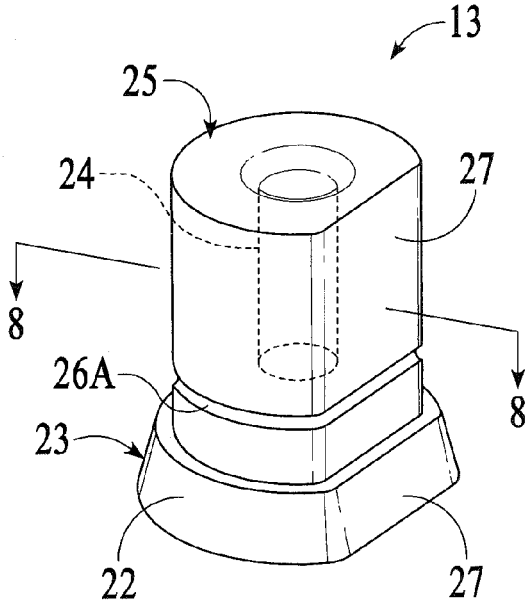
FIG. 7 is an enlarged rear elevational view of the insertable base portion.
Figure 8:
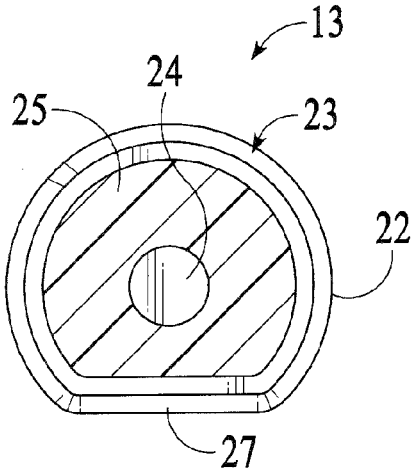
FIG. 8 is a cross section on lines 8-8 of FIG. 7.
Figure 9:
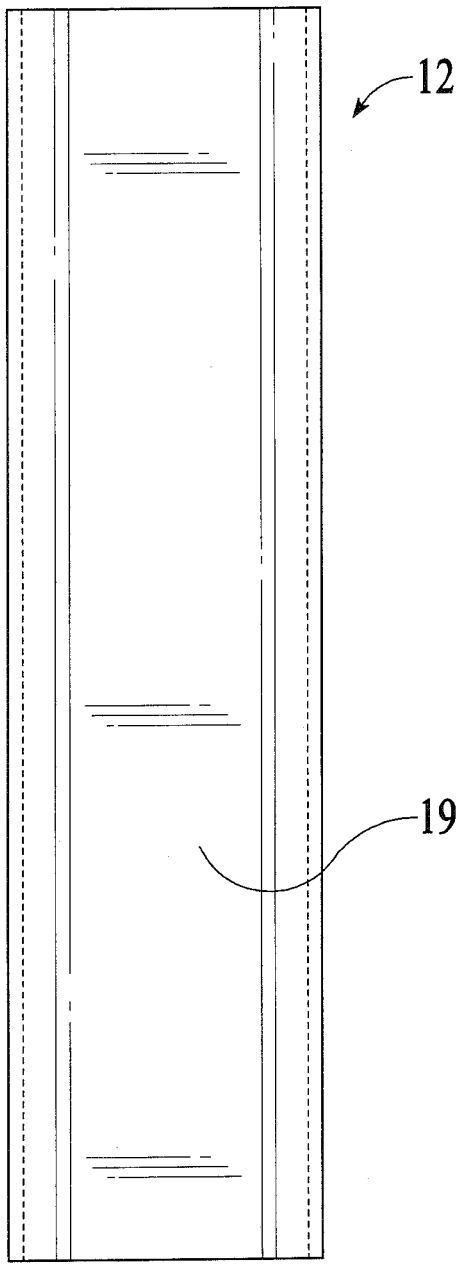
FIG. 9 is a rear elevational view of the handle insert portion of the brush assembly.
Figure 10:
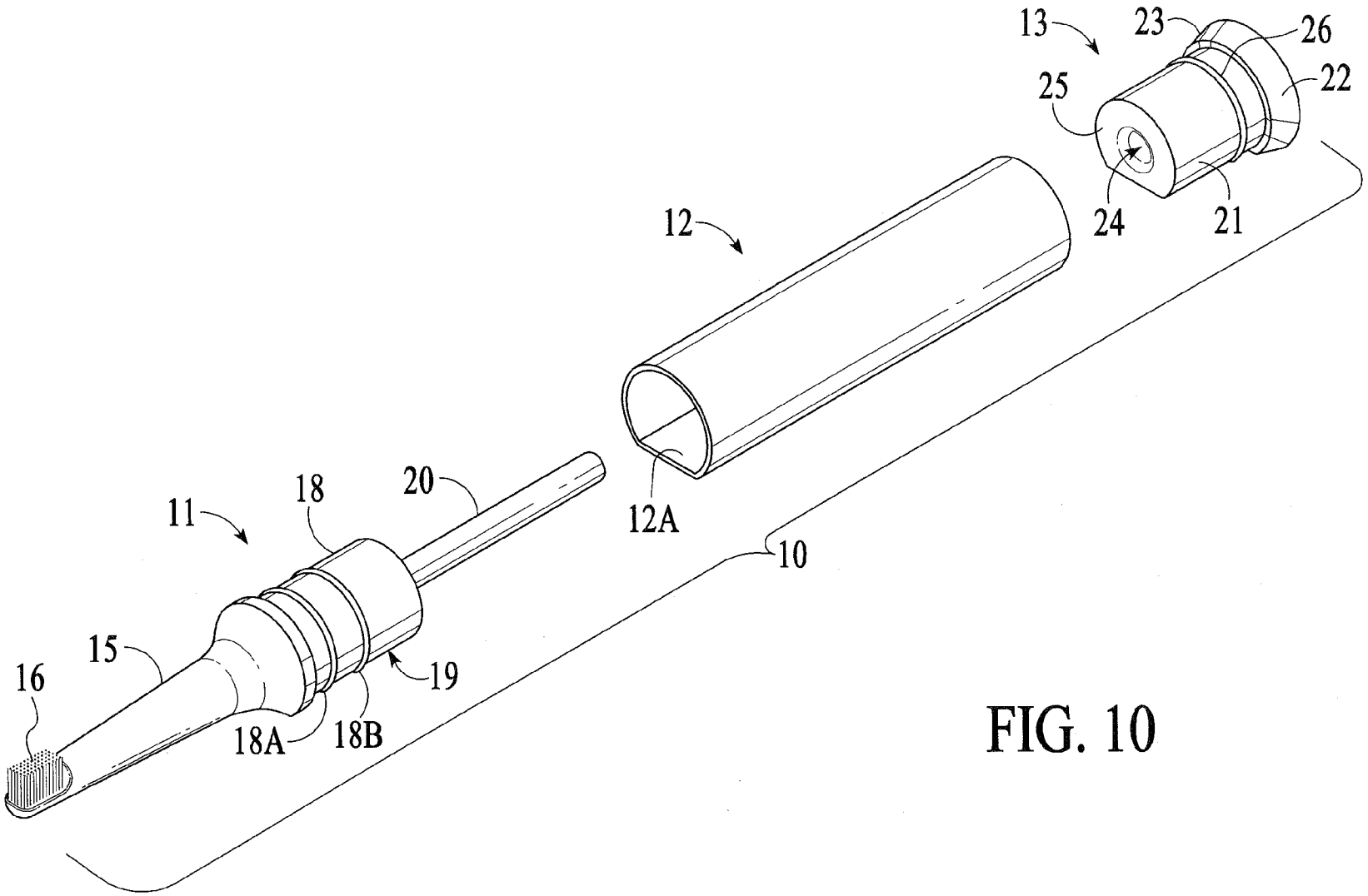
FIG. 10 is an exploded perspective assembly view of the toothbrush configuration of the invention.

Referring to FIGS. 1, 5 and 10 of the drawings, a modular component toothbrush 10 of the invention can be seen having an interchangeable assembly comprised of a brush head portion 11 selectively engaged with a central cylindrical handle portion 12 and a correspondingly handle insert toothbrush base portion 13.

The brush head portion 11 has a main body member 14 with a tapered brush head support portion 15 extending therefrom. A plurality of synthetic resin bristles 16 are uniformly attached and extend freely from a head end portion of reduced transverse dimension defining a bristle insertion mounting area at 17 as will be well understood by those skilled within the art.

The brush head portion 11 has an ovaloid integral handle registration and support surface 18 with multiple annular O-rings 18A and 18B in the respective ring seats in longitudinally spaced relation to one another thereon.

A flattened surface portion 19 defines an alignment key for the insertion of the hollow handle portion 12.

A retainment support shaft 20 extends from and is integral with the handle registration and support 18 on its longitudinal axis for registrational retainment within the toothbrush base portion 13 as will be described in detail hereinafter.

The base portion 13, best seen in FIGS. 5-8 and 10 of the drawings has a generally ovaloid body member 21 with a tapered flange 22 of increased diameter defining a continuous tapered side edge 23 thereabout. A central bore at 24 extends inwardly within its oppositely disposed end 25 for registerably receiving and frictionally retaining the inserted free end portion of the retainment support shaft 20 as best seen in FIG. 5 of the drawings.

An O-ring 26 within a seat 26A is positioned on the ovaloid body member 21 in spaced relation to the flange base 22 providing a sealing relationship between the handle portion and the base when therein engaged.

It will be seen that the base portion 13 has a correspondingly flattened alignment portion 27 for component registration and assembly of the brush 10 of the invention as will be discussed hereinafter.

The hollow handle portion 12 is of a thin wall generally cross-sectionally ovaloid configuration having a longitudinally extending flattened alignment portion 12A and is of an interior dimension greater than that of the exterior of the base portion 13 and the brush head portion 11 which has a correspondingly exterior shape for registration thereover, as best seen in FIGS. 1 and 5 of the drawings.

It will be evident from the above description that in use the modular component toothbrush 10 of the invention is assembled for use by combining the corresponding component parts in interchangeable order selection by the user, as seen in FIGS. 5 and 10 of the drawings.

As such, different colors and ornamental designs of the components can be assembled to achieve a unique toothbrush configuration for each individual user. By use of the registerable engaging universal defined retainment components, a customized toothbrush can be assembled containing a variety of different interchangeable elements such as the hollow handle portion 12 allowing potential users, such as children, to enhance and enrich their tooth brushing experience by providing a fun, effective, build a toothbrush configuration.

It will also be evident from the above description that the orientation of the respective flattened elongated surface on the handle portion 12 and registerable flattened areas on the base 13 and brush head portion 11 provide unique alignment and interengagement to provide proper orientation of the brush head to the most effective handle engagement area typical in such structures.

It will be seen, therefore, that alternate exterior surface keyed configurations may be utilized and as such it will be seen that various changes and modifications may be made thereto without departing from the spirit of the invention.

Therefore I claim:

1. A modular component toothbrush comprising, an interchangeable brush portion, cylindrical hollow handle and a base portion, said interchangeable handle detachably secured between said brush portion and said base portion, said brush portion comprising, a cylindrical body member defining a handle engagement portion registerable within a first end of the hollow handle and further comprising a retainment support shaft extending in axial alignment from said handle engagement portion, said base portion comprising, a cylinder body member, a central bore within and an oppositely disposed terminal extending tapered flange there about, said cylindrical body member of the base portion registerable within a second end of the hollow handle, a free end of the retainment support shaft being engaged within the central bore, an alignment means for longitudinal and axial alignment of said brush portion, handle and base portion to one another, the alignment means comprising, a flattened exterior area of said handle engagement portion, said handle and said base portion, said brush portion having a longitudinally tapered brush head support and a brush head on said brush head support having multiple bristles extending therefrom.

* * * * *